United States Patent [19]

Oppenheimer, Jr.

[11] 4,425,388

[45] Jan. 10, 1984

[54] ADJUSTABLE FLIGHT SIMULATING MOBILE DEVICE

[75] Inventor: Edgar D. Oppenheimer, Jr., Mamaroneck, N.Y.

[73] Assignee: Bird Mobiles, Inc., Scarsdale, N.Y.

[21] Appl. No.: 466,933

[22] Filed: Feb. 16, 1983

[51] Int. Cl.[3] ..... A63H 3/00; A63H 3/16

[52] U.S. Cl. ..... 428/16; 46/124; 428/8

[58] Field of Search ..... 428/8, 12, 16; 46/1 H, 46/32, 124; D21/160; D11/141

[56] References Cited

U.S. PATENT DOCUMENTS

| | | | |
|---|---|---|---|
| 3,290,817 | 12/1966 | Kravath | 428/16 X |
| 3,435,550 | 4/1969 | Carlson | 428/16 X |
| 3,487,569 | 1/1970 | Mendall | 428/16 X |
| 4,131,079 | 12/1978 | Rousseau et al. | 428/16 X |
| 4,239,825 | 12/1980 | Kaulfuss et al. | 428/16 |

*Primary Examiner*—Henry F. Epstein

*Attorney, Agent, or Firm*—Mark T. Basseches; Paula T. Basseches

[57] ABSTRACT

A flight simulating mobile device is disclosed characterized in that any of a variety of different bird, butterfly or like flying creatures may be fabricated of plastic or like material, readily assembled, and balanced in such manner that when suspended in an air current the same provide a realistic replication of a creature in flight.

4 Claims, 5 Drawing Figures

ADJUSTABLE FLIGHT SIMULATING MOBILE DEVICE

BACKGROUND OF THE INVENTION

1. Field of the Invention

The present invention is in the field of decorative devices and pertains more particularly to a mobile device comprising a simulation of a bird, butterfly, insect or the like flying creature which, when suspended in an air current, produces a realistic simulation of flight.

2. The Prior Art

It is well known to provide a mobile device for use as an automobile hood ornament, decoration or the like which functions to move or articulate elements of the device, for example, the wings, responsive to air currents. Such relative movement may be induced by suspending the device in a moving air current or by appending the device to a vehicle or like mechanism which moves through still air.

As examples of prior art, reference is made to the following patents:

U.S. Pat. No. 1,224,044, Thurman
U.S. Pat. No. 1,322,364, Sieveking
U.S. Pat. No. 1,419,694, Sieveking
U.S. Pat. No. 1,511,044, Adams
U.S. Pat. No. 1,566,724, Bates
U.S. Pat. No. 1,579,613, Holmes
U.S. Pat. No. 1,593,085, Lang
U.S. Pat. No. 1,666,543, Vincent
U.S. Pat. No. 1,688,575, Crossett
U.S. Pat. No. 1,738,846, Sancioni
U.S. Pat. No. 1,757,567, Hawes
U.S. Pat. No. 1,774,919, Hawes
U.S. Pat. No. 1,784,988, Hawes
U.S. Pat. No. 1,814,314, Kane et al
U.S. Pat. No. 1,832,357, Brown et al
U.S. Pat. No. 1,846,595, Hawes
U.S. Pat. No. 2,704,908, Lamkin
U.S. Pat. No. 2,704,909, Lamkin
U.S. Pat. No. 3,290,817, Kravath
U.S. Pat. No. 3,487,569, Mendall
U.S. Pat. No. 3,736,688, Caccamo
U.S. Pat. No. 4,114,308, Grieder
U.S. Pat. No. 4,131,079, Rousseau, Jr. et al
U.S. Pat. No. 4,239,825, Kaulfuss et al.

None of the devices of the noted patents is intended to, or functions to provide a creature providing an accurate simulation of flight.

More recently there has been offered for sale (by Bird Mobiles, Inc., 33 Secor Road, Scarsdale, N.Y. 10583) a mobile apparatus which, in fact, provides realistic replication of a bird or like winged creature in flight.

Devices of this latter type have been comprised of a generally planar body portion to which wing portions have been hingedly connected as by strings looped through apertures in the body and wings. A hanger or stretcher is provided having spaced suspension portions forming anchor points for thin flexible filaments extending between the suspension portions of the hanger and spaced points on the wings.

In order to provide an accurate replication of flight, it is necessary that the points of connection between the filament and wings be carefully controlled such that in a still air environment, the creature is suspended with the wings in an essentially horizontal plane whereby when the device is exposed to an air current, the body will oscillate upwardly and downwardly, such that the wings are sequentially inclined downwardly toward the body and upwardly toward the body, providing the desired illusion of flight.

While it is feasible to fabricate a mobile of the type described on a custom basis, wherein the maker by hand is enabled painstakingly to arrive at appropriate balance points, it is virtually impossible to mass produce a mobile of the type described. This is so because even the slightest variations in weight and balance of the wing components will materially affect the suspended orientation of the mobile.

A further complicating factor is encountered when it is desired to provide a variety of different flying creatures, the configurations or silhouettes of which are intended accurately to simulate the configurations of real birds, butterflies or like creatures. Since the wing shapes of such creatures vary markedly one from another, it is evident that their balance points also will vary.

SUMMARY OF THE INVENTION

The present invention proposes to solve the problems inherent in the prior art, and particularly the prior art device described above by providing a means or mechanism for enabling the purchaser of the item readily to assemble the wings in hinged connection to the body portion and accurately to balance the mobile device such that the wings, in static air conditions, assume the desired horizontal position. The facile manner with which the wings may be mounted renders it practical to ship the major components, namely the body and wings, in unattached condition, as opposed to the prior device wherein a permanent hinged arrangement is contemplated, necessitating a larger packaging enclosure, since the wings, during shipment, must necessarily extend laterally from the body portion of the mobile.

More specifically, the invention may be summarized as directed to a mobile including a body portion and wing portions, the noted components including a hinging arrangement which may be snap-fittedly interconnected but which nonetheless provides the desired free pivotal movement of the components.

The invention further contemplates a novel attachment arrangement for the suspensory filaments whereby the same may be shifted by the user axially of the wings, i.e. toward and away from the body portion, whereby the desired balance is achieved.

The attachment arrangement provides a range of connection positions between filament and wings whereby the desired balance is achievable with a wide variety of wing configurations, enabling the manufacturer to provide a variety of flying creatures with a standardized attachment mechanism, the range of adjustment of the attachment mechanism being sufficient to compensate for differences in the balance occasioned by the different wing configurations and body weights.

It is accordingly an object of the invention to provide a mobile which, when suspended in an air current, provides an accurate replication of flight, the device being subject to mass production techniques and being susceptible of shipment in a knocked-down condition, yet being capable of ready assembly.

To attain these objects and such further objects as may appear herein or be hereinafter pointed out, reference is made to the accompanying drawings, forming a part hereof, in which.

Figure 1:
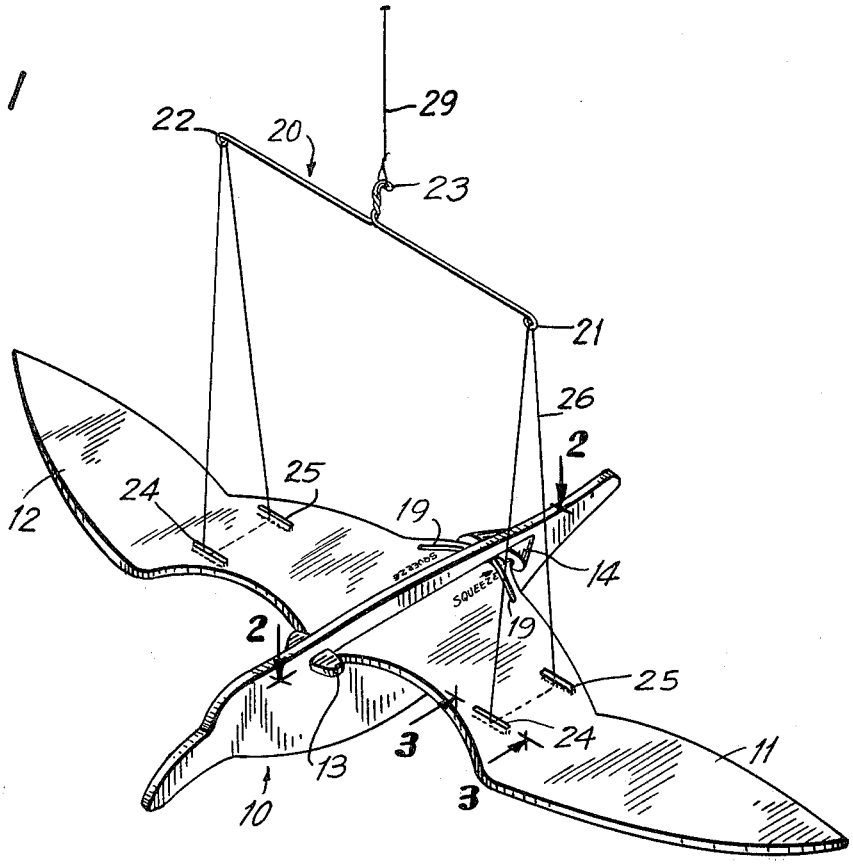
FIG. 1 is a perspective view of a mobile device in accordance with the invention (in this instance a simulation of a sea gull)

Referring now to the drawings, there is shown in FIG. 1 a movable sculpture in the configuration of a bird, the apparatus including a body portion 10 fabricated of plastic or like rigid material in the form of a desired side elevation of a particular bird species, butterfly, etc. The device includes a pair of wing members 11, 12, which are articulatedly connectible to the body 10 in the manner set forth hereinbelow.

The wings 11, 12 are preferably also made of resilient polymeric material.

Figure 2:
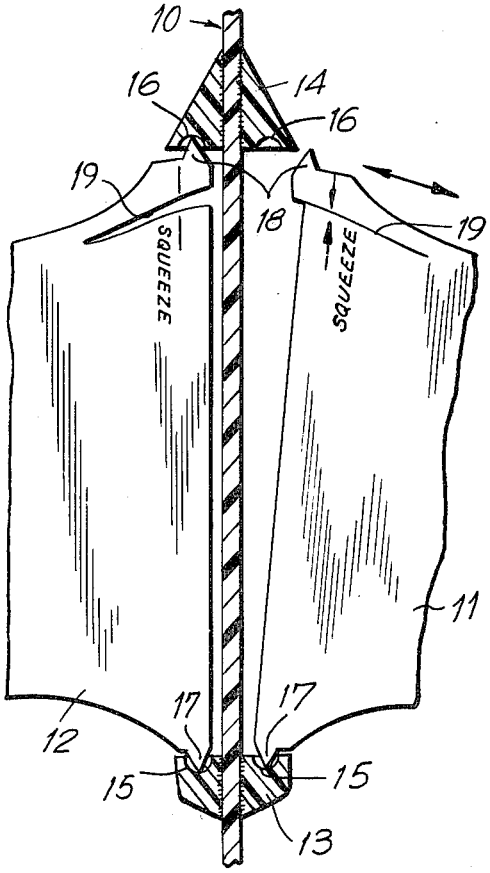
FIG. 2 is a fragmentary plan view of portions of the device at an intermediate stage of assembly.
Figure 3:
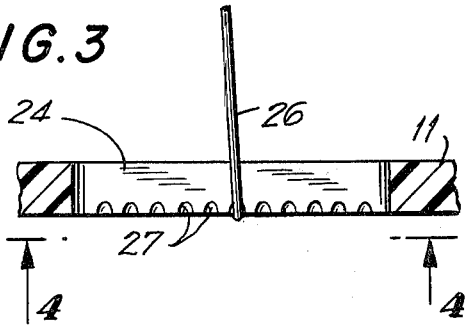
FIG. 3 is a magnified section taken on the line 3—3 of FIG. 1.
Figure 4:
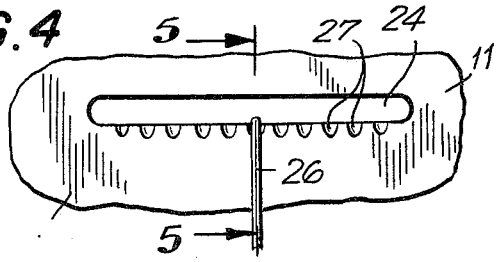
FIG. 4 is a bottom plan view taken in the direction of the arrows 4—4 of FIG. 3.
Figure 5:
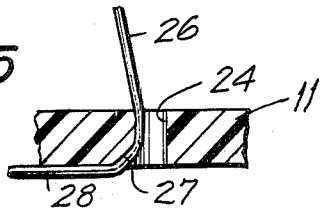
FIG. 5 is a vertical section taken on the line 5—5 of FIG. 4.

The connection between the wings and the body is effected between a spaced pair of carrier members 13, 14 which extend to opposite sides of the body, as best seen in FIGS. 1 and 2.

The carrier members 13, 14, which may be mountable in spaced slots formed through the body portion, include bearing elements or sockets 15, 15, and 16, 16, respectively.

The wing members 11, 12 include at their forward ends pointed bearing receiver portions 17,17. The rear edges of the wings include movable bearing receiver portions 18, 18. The receiver portions 18, 18 are movable relative to the remaining portions of the wings by virtue of the provision of a cutout slot 19 in the wing material.

The normal or unstressed condition of the wing is shown in the left hand side of FIG. 2 wherein it will be perceived that the distance between receiver members 17 and 18 is such that the same extend into sockets 15, 16 pivotally to support the wing 12.

On the right hand side of FIG. 2, the receiver member 18 has been displaced toward the receiver member 17 by pressure applied at the rear surface of the wing, whereby the receiver member 18 is shifted toward the receiver 17, in which condition the member 18 may be swung into bearing member 16.

Following release of the rear portion of the wing, the receiver member 18 will snap into the bearing 16 and reassume the configuration of the wing 12, as depicted in in FIG. 2.

The apparatus includes a hanger member 20 of wire or the like, the hanger including suspension eyes 21, 22 and a central suspension hook 23.

The wings 11 and 12 include spaced parallel adjustment slots 24, 25.

A suspension filament 26 formed of thin monofilament nylon or like flexible filamentary thread or material is passed through each of the eyes 21, 22 and extends through the spaced slots 24, 25, as clearly shown in FIG. 1.

As will be evident from an inspection of FIG. 1, the position within the slots 24, 25 through which the filament 26 passes is critical to the balanced condition of the device.

More particularly, if the thread 26 extends through slots 24, 25 at a position remote from the body, the weight of the wing portion outward of the thread will be unduly small and the bird will hang in such manner that the wings will incline downwardly from the tip to the body. Conversely, if the point of engagement of the thread or filament within the slots is unduly close to the body, the wings will incline downwardly from the body to the tip.

In order to assure that the adjusted position of filament 26 to the wings may be accurately and fixedly achieved, the slots 24, 25, on their inwardly facing surfaces, may be provided with a series of serrations or anchor points 27 at the under surface of the slot, whereby elements of the bight or loop portion 28 of the filaments will enter into the serrations 27, precluding inadvertent shifting of the bight relative to the wing.

When the device of FIG. 1 is suspended in a moving current of air, the same will appear to fly since the air current will deflect the components in such manner that the body is first above and then below the level of the wings.

The hook member 23 may be used as the anchor point for a further suspended filament 29, which may depend from any desired structural member, such as the limb of a tree, a hook affixed to a house, etc.

From the foregoing description it will be readily apparent that there is shown and described in accordance with the invention a novel, movable sculpture or mobile which is inexpensive to manufacture, may be shipped in knocked-down condition for ready assembly by the user, and which may be easily balanced so as to hang in a "wings horizontal" configuration.

A highly desirable feature of the invention resides in the provision of the elongate slots 24, 25 which enable a substantial adjustment to be effected relative to the balanced condition of the device. The provision of such slots (as opposed to fixed suspensory apertures) enables the user to adjust for inaccuracies or irregularities in the weight of the wings, a feature which is particularly important in a mass produced item.

In addition, the adjustment provided by the slots is such that any of a wide variety of wing widths and configurations may be employed, permitting a balanced condition of the device to be achieved with the slots set a standard distance from the body adjacent edges of the wings.

Thus, it is possible to fabricate a butterfly, birds of a variety of types, etc., all of which articles will necessarily have different balance points, through the provision of adjustment slots spaced a standardized distance from the body adjacent ends of the wings.

As will be recognized by the skilled worker in the art familiarized with the instant disclosure, numerous variations in details of construction may be made without departing from the spirit of the invention, which is to be broadly construed within the scope of the appended claims.

Having thus described the invention and illustrated its use, what is claimed as new and is desired to be secured by Letters Patent is:

1. A flight simulating mobile device having the appearance of a bird or like flying creature comprising a rigid body portion having a configuration, in side elevation, in simulation of the side elevation configuration of the creature, a pair of wing support members mounted on said body portion, said support members being mutually spaced apart in the general direction of the longitudinal axis of said body portion, said support members extending generally transversely relative to said body portion and each including a pair of carrier portions projecting beyond each side of said body portion, a bearing element formed on each said carrier portion, the bearing elements on each side of said body portion being in substantial coaxial alignment to define a pivot axis at each side of said body portion, a wing member comprised of resilient material pivotally mounted between the bearing members to each side of said body portion, each said wing member including a spaced pair of bearing receiver portions pivotally engaging a said bearing element, at least one said bearing receiver portion of each said wing being resiliently deflectible toward said other bearing receiver member, the distance between said receiver members exceeding the distance between the bearing members in the undeflected condition of said receiver portions and being less than the distance between said bearing members when said receiver members are biased toward each other.

2. A mobile device in accordance with claim 1 and including a hanger member, a pair of suspension portions formed in spaced relation at the distal ends of said hanger portion, a suspension thread extending between each said suspension portion and a suspension point on a different one of said wings, and adjustment means on said wings for shifting the connection between said threads and said suspension points toward and away from said body portion, thereby to achieve a desired balance whereat said wings are generally horizontally disposed.

3. A mobile device in accordance with claim 2 wherein said suspension threads include bight portions, and said adjustment means comprises a pair of slots on each said wing, said slots being spaced apart in the direction of the axis of said body portion and being elongated in a direction normal to said axis, said bights of said threads extending through said slots.

4. A mobile device in accordance with claim 3 wherein said slots include a plurality of enlargement portions defining positioning means for said bights.

* * * * *